United States Patent [19]

Rabette

[11] 4,394,652

[45] Jul. 19, 1983

[54] DATA DISPLAY SYSTEM

[75] Inventor: Jean Rabette, Bondues, France

[73] Assignee: Societe Vandeputte Fils & Cie, S.A., Tourcoing, France

[21] Appl. No.: 270,007

[22] Filed: Jun. 3, 1981

[30] Foreign Application Priority Data

Jul. 18, 1980 [FR] France ..... 80 16076

[51] Int. Cl.[3] ..... G09G 3/34

[52] U.S. Cl. ..... 340/764; 340/783; 340/815.08; 340/815.23; 40/449

[58] Field of Search ..... 340/378.2, 378.5, 763, 340/764, 783, 815.02, 815.04, 815.23, 815.24, 815.26, 815.29; 40/447, 449, 470, 473, 482, 484, 506

[56] References Cited

U.S. PATENT DOCUMENTS

| | | | |
|---|---|---|---|
| 3,307,170 | 2/1967 | Aoyama et al. | 340/764 |
| 3,638,550 | 2/1972 | Hereford | 354/234 |
| 3,924,226 | 12/1975 | Lacy et al. | 340/764 |
| 3,949,392 | 4/1976 | Caritato | 340/764 |

*Primary Examiner*—Marshall M. Curtis

*Attorney, Agent, or Firm*—Kerkam, Stowell, Kondracki & Clarke

[57] ABSTRACT

The invention refers to a system for data display by means of magnetically controlled bistable rotors.

It is characterized by the fact that this point is itself comprised of several colored ranges which are juxtaposed and borne by distinct rotors (101, 102, 103, 104) grouped to be controlled synchronously and by the fact that, so that all the rotors of the same group are activated at the same time, this system includes a single electromagnet (10) the poles (17, 18) of which are placed in the plane of the axes of the rotors on either side of this group of rotors so as to directly exert their effect only on the permanent magnets (6) of the rotors (101, 102, 103, 104) located at the ends of the group, and this exclusively on their pole oriented towards the outside of the group.

Application to display of data which must be read at great distances.

2 Claims, 2 Drawing Figures

Fig. _1
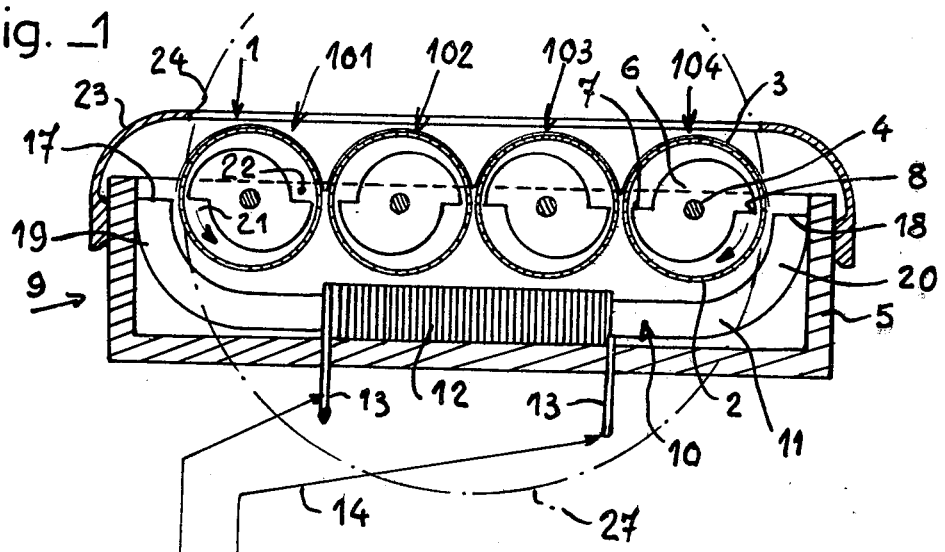
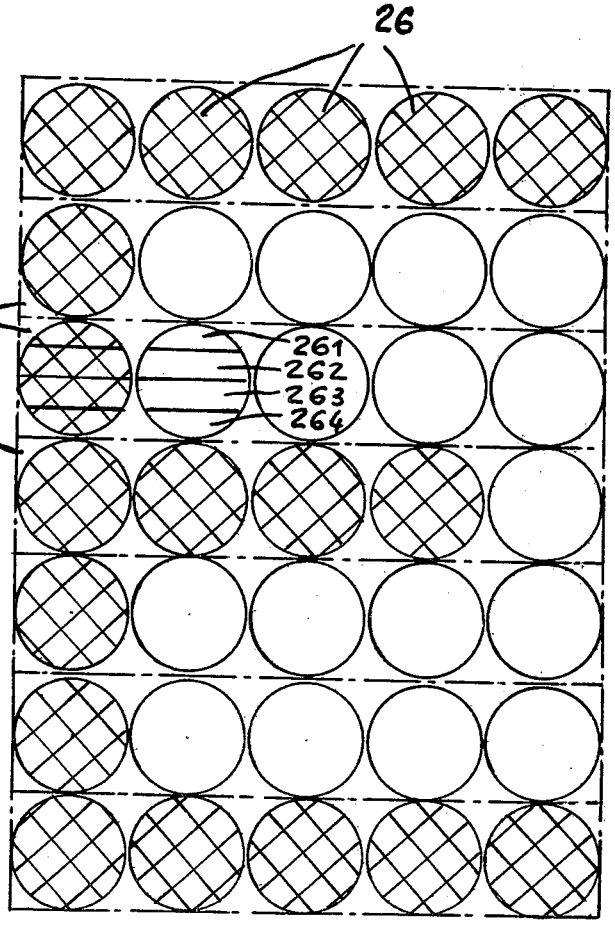
Fig. _2

DATA DISPLAY SYSTEM

BACKGROUND OF THE INVENTION

The invention concerns a system for data display by means of magnetically controlled bistable rotors. Such systems are already known (French Pat. No. 79.17804). They include at least two rotors, each formed by a body having ranges of different colors in two diametrically opposite areas and which rotates freely in a mounting to which it is associated by a shaft.

A permanent magnet, the position of which is such that the line passing through its poles is essentially radial to the axis of the shaft, interlocks in rotation with this body.

To control the body's rotation, this magnet cooperates with one pole of an electromagnet connected to a source of direct current by an inverter-interruptor.

The operating principle of such a bistable element is simple.

A problem arises, however, when for example in order to be read at a very great distance the designation controlled by a single electromagnet must have a large surface, since each range able to achieve an elementary designation must itself be very broad.

In the designs known to date, the electromagnet generally acts on a simple rotor which, in order to carry this elementary designation, must provide opposing surfaces at least as large as those of said designation, and therefore, whether the rotor is cylindrical, spherical or flat, it requires a significant space, if only during its operation, which can only be reserved for it in very thick panels.

Furthermore, for its operation it requires an equally significant motor torque.

In order to limit these drawbacks, it is known (U.S. Pat. No. 3,924,226) that each elementary designation can be distributed over two contiguous rotors controlled synchronously by a common electromagnet.

In this known design, the electromagnet has its two poles spaced the same distance apart as the axes of the two rotors behind which they are placed so that each of them controls one of the rotors by repulsion of the identical pole and attraction of the opposite pole of the permanent magnet.

In this design, the pole of the permanent magnet identical to that of the electromagnet therefore remains free, and its repulsion and attaction force is therefore not exploited. This obviously results in a loss of power.

Furthermore, utilization of this electromagnet thus assembled is necessarily limited to the control of one rotor per pole and therefore of two rotors, which still often provides a surface too small to carry an elementary designation legible from afar.

SUMMARY OF THE INVENTION

One result which the invention seeks to obtain is control of any number of rotors with a single electromagnet, the power of which need be virtually no greater than that required to control a single rotor.

To achieve this, the invention concerns a data display system of the type cited above, in particular characterized by the fact that this point itself consists of several colored ranges which are juxtaposed and borne by distinct rotors grouped to be controlled synchronously, and by the fact that, so that all the rotors in a single group are activated at the same time, this system includes a single electromagnet the poles of which are arranged on the plane of the axes of the rotors and on either side of this entire group of rotors so as to directly exert their effect only on the permanent magnets of the rotors located at the ends of the group, and this exclusively on their pole oriented towards the outside of the group.

BRIEF DESCRIPTION OF THE DRAWINGS

This will be fully understood with the aid of the following description of a preferred embodiment given by way of nonlimiting example, with reference to the attached drawing which shows diagrammatically:

FIG. 1: a data display system seen in section along a plane perpendicular to the rotors' axis of rotation;

FIG. 2: a character reconstruction system seen face-on.

DESCRIPTION OF THE PREFERRED EMBODIMENT

With reference to FIG. 1, it can be seen that each display system includes rotors 101, 102, 103, 104 each formed by a body 2 which, in this case, is cylindrical, the lateral surface of which carries at least locally in two diametrically opposite areas different designations, such as a colored lozenge 3, placed over at least one of these areas so that they have different colored ranges, for example, one yellow and reflecting, the other black and flat. The rotor 1 is borne by a shaft 4 which is guided rotating in a support 5. In order to correctly orient the rotor to make it present the designation needed at the moment, it is rotated by magnetic means including:

a permanent magnet 6 interlocked in rotation with the body 2 of the rotor 1 to which it is affixed in a position such that the line passing through its north 7 and south 8 poles, i.e., radial to the axis of the rotor's rotation shaft 4;

a stator 9 formed between other parts of the support 5;

an electromagnet 10, attached to this support 5 and having a rod 11 of a magnetic material bent into a U-shape and a coil 12 connected to two connection pins 13, a circuit 14 joining the pins 13 to a direct-current source 15 through an inverter-interruptor 16 allowing short and reversible supply of the coil 12.

The rod 11 can therefore be temporarily supplied so that the end 17 or 18 of each of these pins 19, 20 creates at will a north or south pole.

These poles of the electromagnet are located in the plane perpendicular to the rotor axes, in which the poles of the permanent magnets can turn.

In the example shown in the drawing, it can be seen that the permanent magnet has contours or scallops 21, 22 which, in its polar areas, very precisely delimit on either side of the line passing through the poles fractions of a polar area in which the distances in relation to the axis of rotation are different from one another and diametrically opposite.

This type of permanent magnet, more amply described in French Patent Application No. 79.17804, is in particular aimed not at forming a canting cam as in U.S. Pat. No. 3,638,550 but at preventing the rotor 1 from becoming stabilized in a position in which the line passing through the poles 7, 8 of the permanent magnet 6 would merge with the resultant of the forces exerted by the corresponding pole of the electromagnet 10.

With this permanent magnet, just as if it had been dephased by classic magnetic and/or mechanical means at the moment of inversion of the magnetic field in the electromagnet 10, the rotor pivots, but unlike the rotors dephased by classic means it always pivots in the same direction, i.e., towards the fraction of polar area closest to the axis 4.

As in the aforementioned patent application, a screen may be placed in front of the display unit in order to protect the bistable rotors. Facing each body 2, it may then have contours 24 in the form of the sign 26 to be called up, and for example circular, which then makes it possible to place over the bodies colored lozenges 3 broader and of a contour independent of that of the designation to be called up.

The most widespread application of such display systems is the reconstruction of characters such as letters, figures, drawings or miscellaneous signs, for example through seven horizontal rows 25 of five points 26, each having an apparent section, for example circular or rectangular.

In the case of points 26 which must be read at a great distance, those of major diameter or width are each constituted by several colored, distinct fields forming elements of designations 261, 262, 263, 264 carried by several rotors 101, 102, 103, 104 juxtaposed and controlled synchronously.

In fact, these rotors 101, 102, 103, 104, the axes of which are located in the same plane, must then be controlled synchronously in order to be always held in place at the same time or activated at the same time, as the case may be.

According to an essential characteristic of the invention, for the synchronous control of several juxtaposed rotors, the system includes a single electromagnet 10 the poles 17, 18 of which are arranged in the plane of the rotors' axes and on either side of the entire group of rotors to be synchronized 101, 102, 103, 104 so as to directly exert their forces, whether of repulsion or of attraction, only on the permanent magnets of the rotors placed at the ends of the group and this on their pole oriented towards the outside of the group of rotors.

When there are more than two and for example four rotors 101, 102, 103, 104 constituting the group, it is then found that the reciprocal action of the other poles of the permanent magnets of the end rotors assures simultaneous movements in the intermediate rotors.

This is why a single electromagnet can control more than two rotors.

In the case of a permanent magnet contoured as indicated above, and which therefore always turns in a given direction under the direct control of the electromagnet, the permanent magnets of the end rotors are preferably arranged so as to turn in a normal direction.

The magnets of the intermediate rotors such as 102 and 103 may in contrast be cylindrical, without contours, since they are rotated by the turning fields of the end magnets 101 and 104.

In the case where a single point is, as explained above, composed of several elementary designations distributed over several rotors, instead of several scallops 24 having a contour equivalent to each elementary designation for each point 26, the screen then preferably has a single scallop extending above the group of bodies.

What I claim is:

1. Data display system having a group of at least two parallel rotors (101 to 104) each formed by a single body (2), having in two diametrically opposite areas ranges of different colors, which rotates freely in a mounting (5) to which it is associated by a shaft (4), which is in contrast interlocking in rotation with a permanent magnet (6) the position of which is such that the line passing through its poles (7, 8) is essentially radial to the axis of the shaft (4), in which system end rotors (101, 104) of the group of at least two parallel rotors, to control their rotation, each cooperate with one pole of an electromagnet (10) connected to a source (15) of direct current by an inverter-interruptor (16) and which is attached to the mounting (5) in such a way that each pole is located in the plane perpendicular to the axis of the rotors in which the poles of the permanent magnets may turn, and in said system the datum to be displayed, such as a sign, a letter, a figure or a design, consist of at least one point the entire apparent surface of which is always of one color, for example light, or of another, for example dark, this point is itself formed of several colored ranges which are juxtaposed and borne by distinct ones of the group of rotors (101, 102, 103, 104) grouped to be controlled synchronously and, so that all the rotors of the same group may be activated at the same time, the system includes a single electromagnet (10) having poles (17, 18) located in the plane of the axes of the rotors, on either side of the entire group of rotors so as to directly exert their effect only on the permanent magnets (6) of the rotors (101, 104) located at the ends of the group and only on their pole oriented towards the outside of the group.

2. Data display system having a group of at least three parallel rotors (101 to 104) each formed by a single body (2), having in two diametrically opposite areas ranges of different colors, which rotates freely in a mounting (5) to which it is associated by a shaft (4), which is in contrast interlocked in rotation to a permanent magnet (6) the position of which is such that the line passing through its poles (7, 8) is essentially radial to the axis of the shaft (4), in which system end rotors (101, 104) of the group of the at least three rotors, to control their rotation, each cooperate with one pole of an electromagnet (10) connected to a source (15) of direct current by an inverter-interruptor (16) and which is attached to the mounting (5) so that each pole is located in the plane perpendicular to the axis of the rotors, in which system the datum to be displayed, such as a sign, a letter, a figure or a design, consists of at least one point the entire apparent surface of which is always of one color, for example light, or another, for example dark and, so that all the rotors of the same group are activated at the same time, the system includes a single electromagnet (10) controlling the end rotors which, solely by their turning field, control the at least one intermediate rotor.

* * * * *